US005558059A

United States Patent [19]

Yoshinaga et al.

[11] Patent Number: 5,558,059

[45] Date of Patent: Sep. 24, 1996

[54] POWER UNIT FOR A SITTING-TYPE VEHICLE

[75] Inventors: Kei Yoshinaga; Katsuhiko Ito; Katsumi Ebara; Hitoshi Furuhashi; Takashi Shichinohe; Masaharu Omagari, all of Saitama, Japan

[73] Assignee: Honda Giken Kogyo Kabushiki Kaisha, Tokyo, Japan

[21] Appl. No.: 501,652

[22] Filed: Jul. 12, 1995

[30] Foreign Application Priority Data

Jul. 12, 1994 [JP] Japan ..... 6-160429

[51] Int. Cl.[6] ..... F02B 77/00

[52] U.S. Cl. ..... 123/198 E

[58] Field of Search ..... 123/198 E

[56] References Cited

U.S. PATENT DOCUMENTS 4,267,805 5/1981 Schmuck ..... 123/198 E
4,883,031 11/1989 Ampferer et al. ..... 123/198 E
4,977,870 12/1990 Hashimoto et al. ..... 123/198 E
4,993,381 2/1991 Absenger ..... 123/198 E

FOREIGN PATENT DOCUMENTS 2-112622 10/1988 Japan .

*Primary Examiner*—David A. Okonsky
*Attorney, Agent, or Firm*—Birch, Stewart, Kolasch & Birch, LLP

[57] ABSTRACT

A generator is provided inside the casings of a power unit which is fitted to the rear end of a crank shaft. The generator has a stator provided to a generator cover detachably fitted to cover a rear opening of the casing. A harness extends from the stator and is led outside through a grommet provided between the joining faces of the casing and the generator cover. A space is formed behind the generator cover to insert a tool such as an impact wrench with the power unit left mounted on the vehicle body. It is possible to detach and maintain the generator only by detaching the generator cover while leaving the power unit mounted on the vehicle body.

8 Claims, 11 Drawing Sheets

POWER UNIT FOR A SITTING-TYPE VEHICLE

BACKGROUND OF THE INVENTION

1. Field of the Invention

The present invention relates to an improved power unit for a sitting-type vehicle having an output shaft connected to driving wheels and projecting in a longitudinal direction of the vehicle body from a casing for an engine mounted in the longitudinal direction of the vehicle body.

2. Description of Background Art

There have already been known various power unit devices as disclosed in, for example, Japanese Patent Application Laid-open No. Hei. 2-112622.

When a crank shaft and an output shaft are provided in parallel in the longitudinal direction of a vehicle body as described above, a power transmission provided between them can be composed of only flat gears. Front and rear driving axles mounted to front and rear wheels can be linked with an output shaft directly. The resulting power unit can be made to be simple in structure with a high rate of transmission efficiency together with many other advantages.

When electric devices, including a generator, are fitted to the inner surface of a front cover or a rear cover connected to an opening provided at either a front or rear section of a casing for an engine in a power unit of the type described above, the maintenance cannot be performed unless the cover is detached from the casing. Such a front cover or rear cover generally includes an output shaft passing therethrough. However, detaching the output shaft requires a driving axle extending from the output shaft to a front or rear wheel to be detached, making the required work extremely troublesome.

SUMMARY AND OBJECTS OF THE INVENTION

In view of this problem, the present invention has an object to provide a power unit which allows easy maintenance of electric devices provided inside the power unit.

To achieve the above object, a power unit for a sitting-type vehicle according to the invention comprises an output shaft connected to driving wheels projecting in the longitudinal direction of a vehicle body from a casing for an engine with a crank shaft mounted in the longitudinal direction of the vehicle body. The casing has a cover detachably provided thereto at a position off the output shaft on the front or rear surface of the casing. The cover has fitted to its inner surface electric devices and harnesses extending from the electric devices are taken outside the cover between joining surfaces of the casing and the cover.

The power unit includes a space at the front or rear section of the cover to detach the cover from the casing while leaving the engine mounted on the vehicle body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described in detail with reference to the accompanying drawings.

Figure 1:
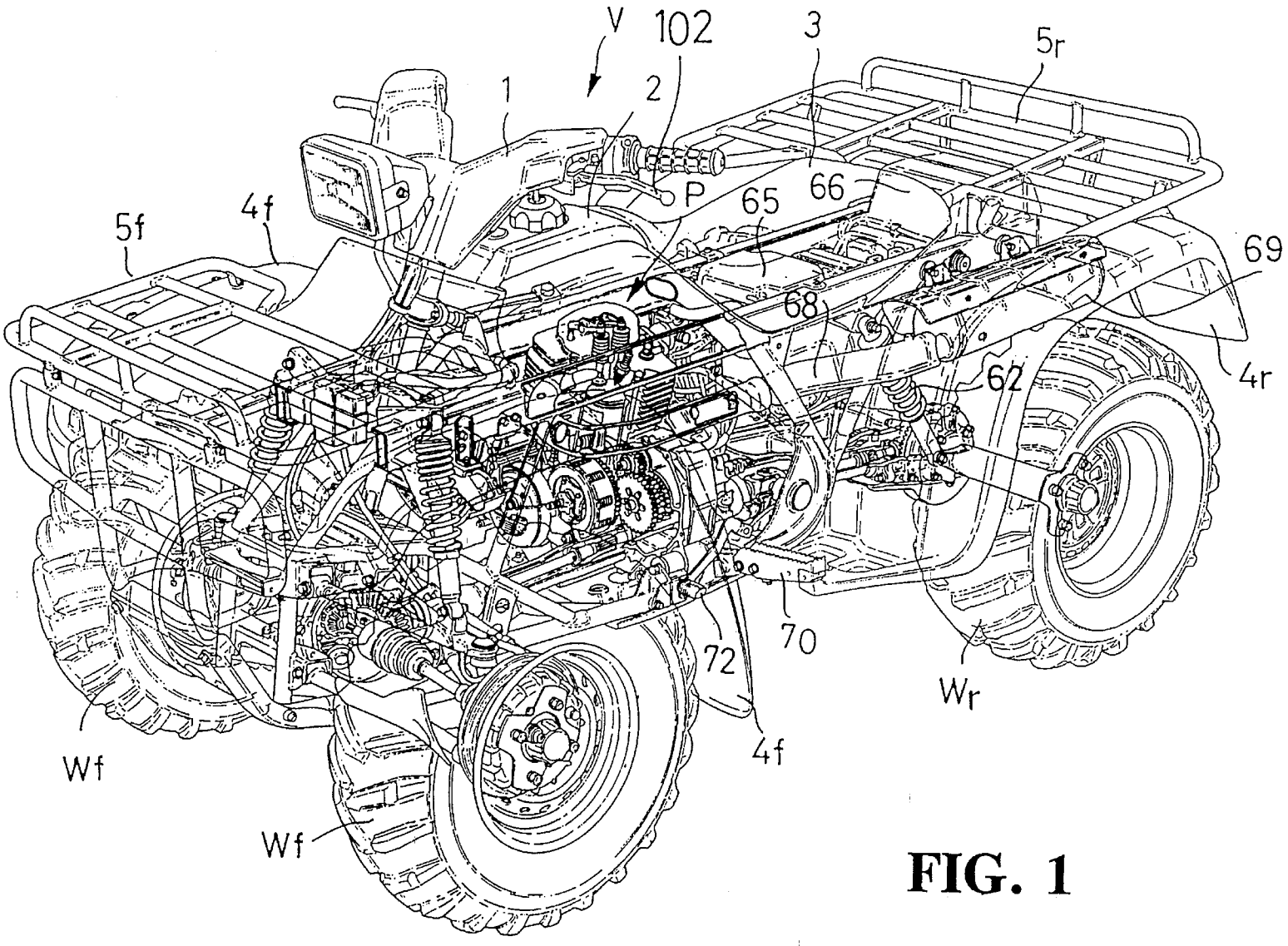
FIG. 1 is a perspective view showing the entire body of a sitting-type vehicle.
Figure 2:
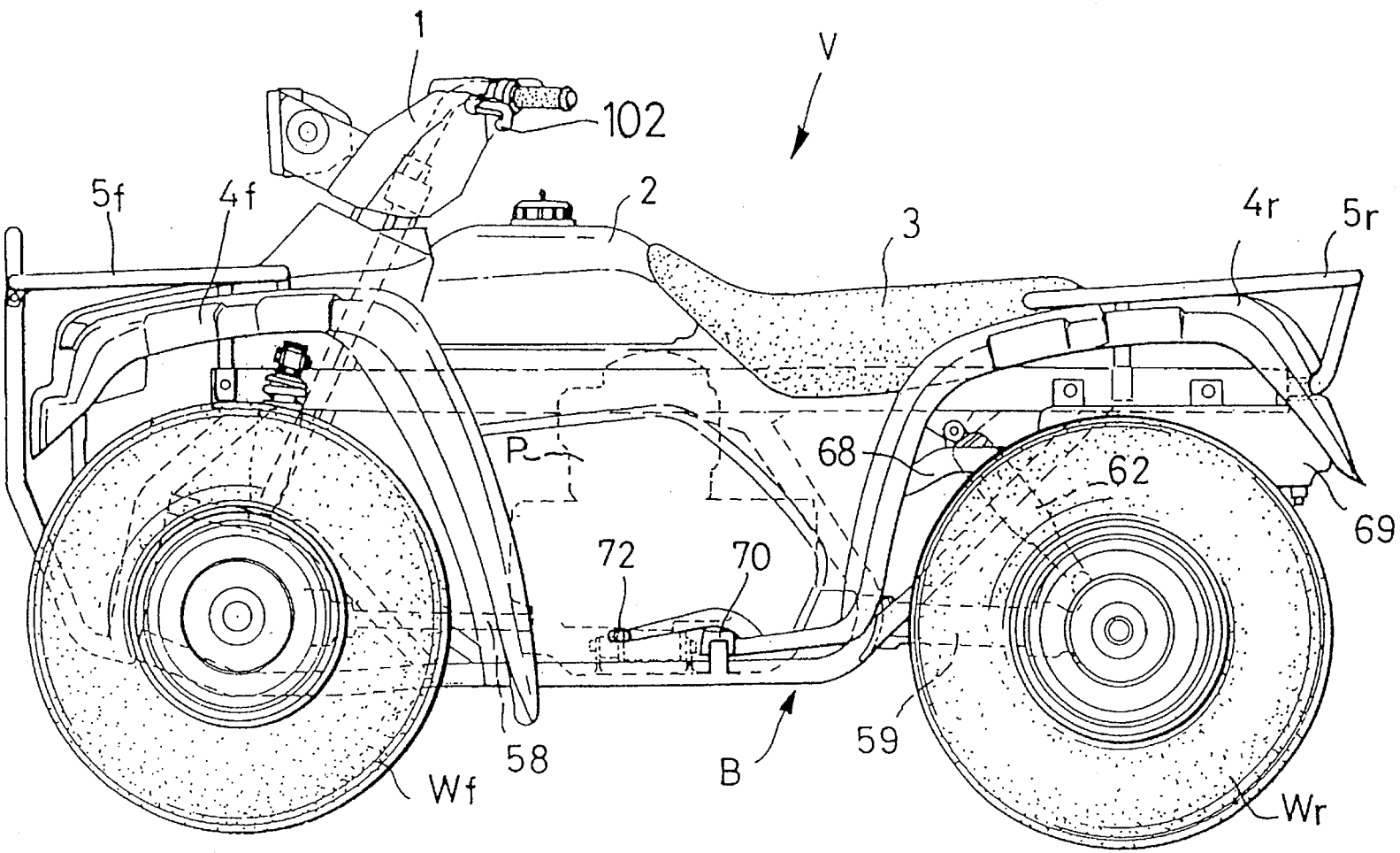
FIG. 2 is a side view showing the entire body of a sitting-type vehicle.

As shown in FIGS. 1 and 2, a pair of right and left front wheels Wf, Wf and right and left rear wheels Wr, Wr are provided, respectively, at the front and rear sections of a body frame B of a sitting-type vehicle V. Balloontype tires are mounted to the front wheels Wf, Wf and rear wheels Wr, Wr. A handle bar 1, a fuel tank 2 and a sitting seat 3 are mounted on the body frame B. Under the fuel tank 2 and the seat 3 and at the center of the body frame B, there is mounted a power unit P to drive the front wheels Wf, Wf and the rear wheels Wr, Wr.

Further fitted to the body frame B are pairs of front and rear fenders 4*f*, 4*f* and 4*r*, 4*r* covering roughly the upper halves of the front and rear wheels Wf, Wf and Wr, Wr and having provided to their upper surfaces carriers Sf, Sr.

Figure 3:
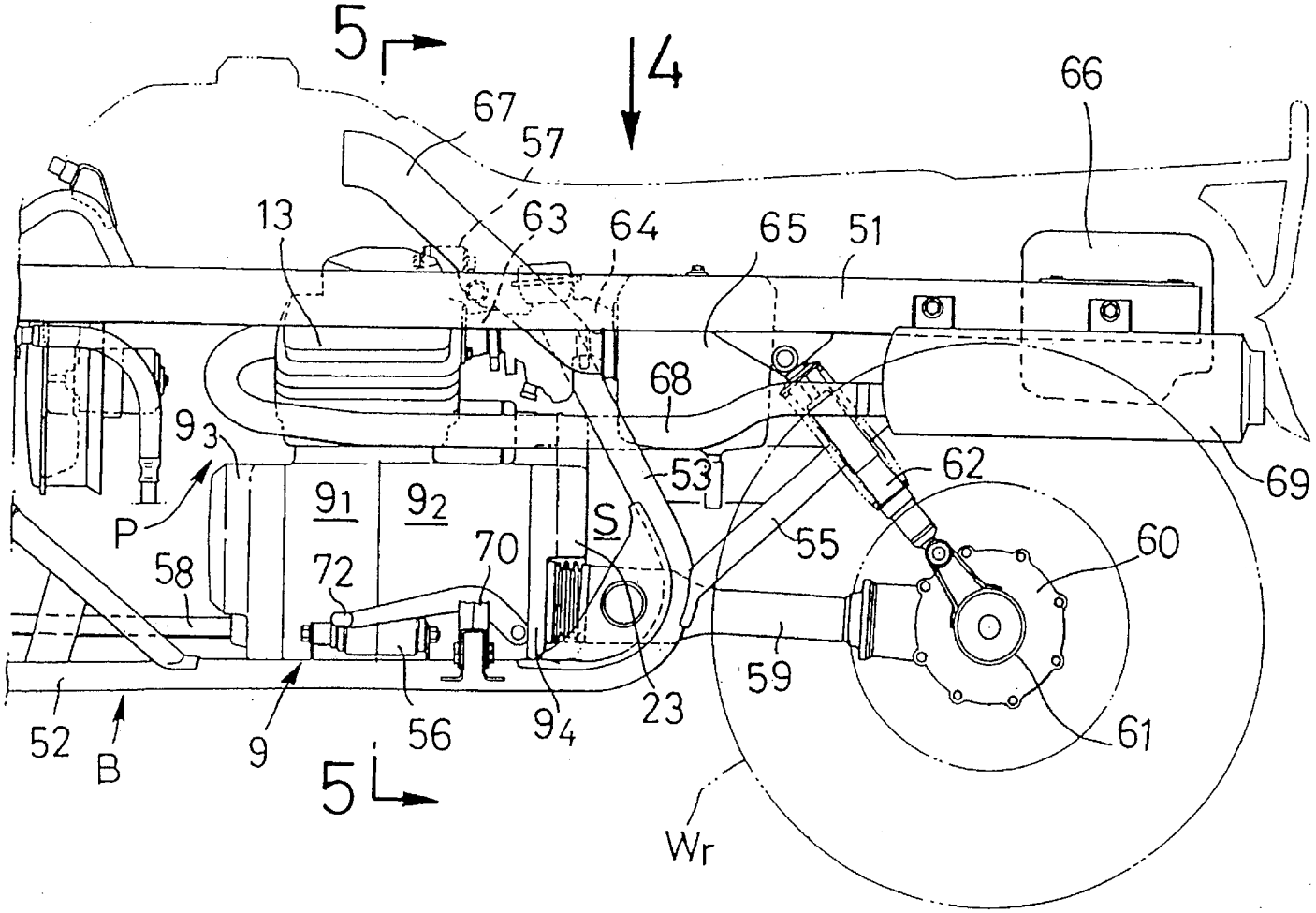
FIG. 3 is a rear side view of a sitting-type vehicle.
Figure 4:
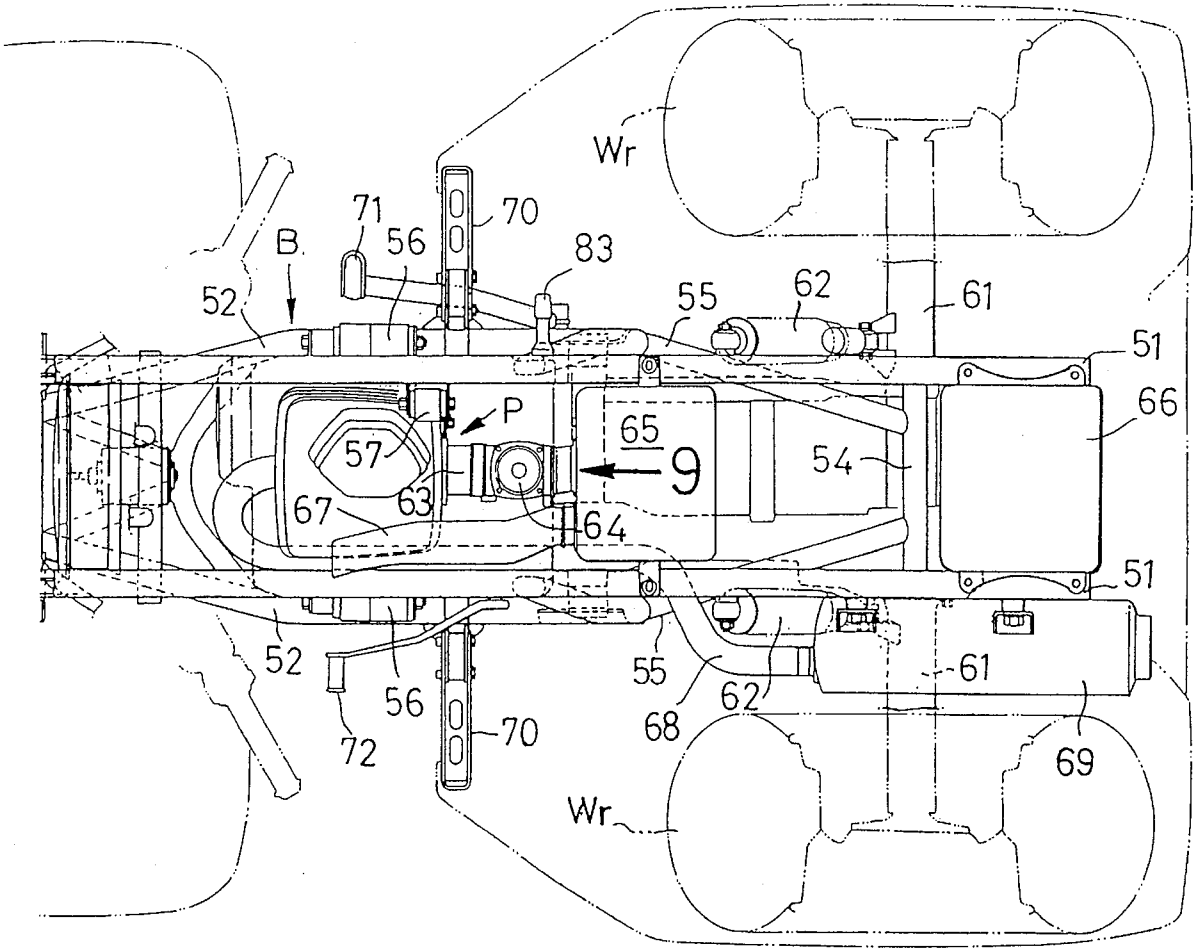
FIG. 4 is a view as seen in a direction shown by an arrow 4 in FIG. 3.

As is apparent from FIGS. 3 and 4 seen together, the body frame B has a pair of right and left side members 51, 51 extending in the longitudinal direction of the vehicle body, a pair of right and left lower pipes 52, 52 extending under the side members 51, 51 in the longitudinal direction of the vehicle body, a pair of right and left rear pipes 53, 53 extending upwardly from the rear ends of the lower pipes 52, 52 to be connected to the lower surfaces of the side members 51, 51 and a pair of right and left stays 55, 55 rising upwardly from the lower ends of the rear pipes 53, 53 and connected to a cross member 54 connecting side members 51, 51 to each other.

The power unit P includes a lower section supported by the right and left lower pipes 52, 52 via a pair of right and left elastic mounting members 56, 56. The upper section of the power unit P is supported by the right side member 51 via an elastic mounting members 56. A front driving axle 58 and a rear driving axle 59 project, respectively, from the front and rear sections of the power unit P. The rear driving axle 59 is linked to the rear wheels Wr, Wr through a rear differential gear 60. Rear axle cases 61, 61 are connected to the right and left side members 51, 51 through rear cushions 62, 62.

An inlet pipe 63, a carburetor 64, an air cleaner 65 and an article box 66 are provided over a rear surface of the upper section of the power unit P. The air cleaner 65 includes an air intake pipe 67 connected thereto. An exhaust pipe 68 bends backward from a rear surface of the upper section of the power unit P extending backward under the lower surface of the left side member 51 to connect to a muffler 69 supported to the rear lower surface of the side member 51. The rear section of the exhaust pipe 68 and the muffler 69 are accommodated in a space formed between the left rear wheel Wr and left rear cushion 62.

Since the inlet pipe 63 and the exhaust pipe 68 extend in the longitudinal direction of the vehicle body from the power unit P, it is possible to provide a large and comfortable leg space for a driver on the right and left sides of the power unit P. With the rear section of the exhaust pipe 68 and the muffler 69 accommodated between the rear wheel Wr and the rear cushion 62, it is also easy to provide a space for installing items such as the air cleaner 65 and the article box 66.

At the center of the lower sections, the lower pipes 52, 52 have fitted thereto a pair of right and left steps 70, 70 projecting outwardly on the right and left sides of the power unit P to support the feet of a driver sitting on the seat 3. In the vicinity of the right step 70 and the left step 70, there are provided a brake pedal 71 and a change pedal 72, respectively.

Figure 5:
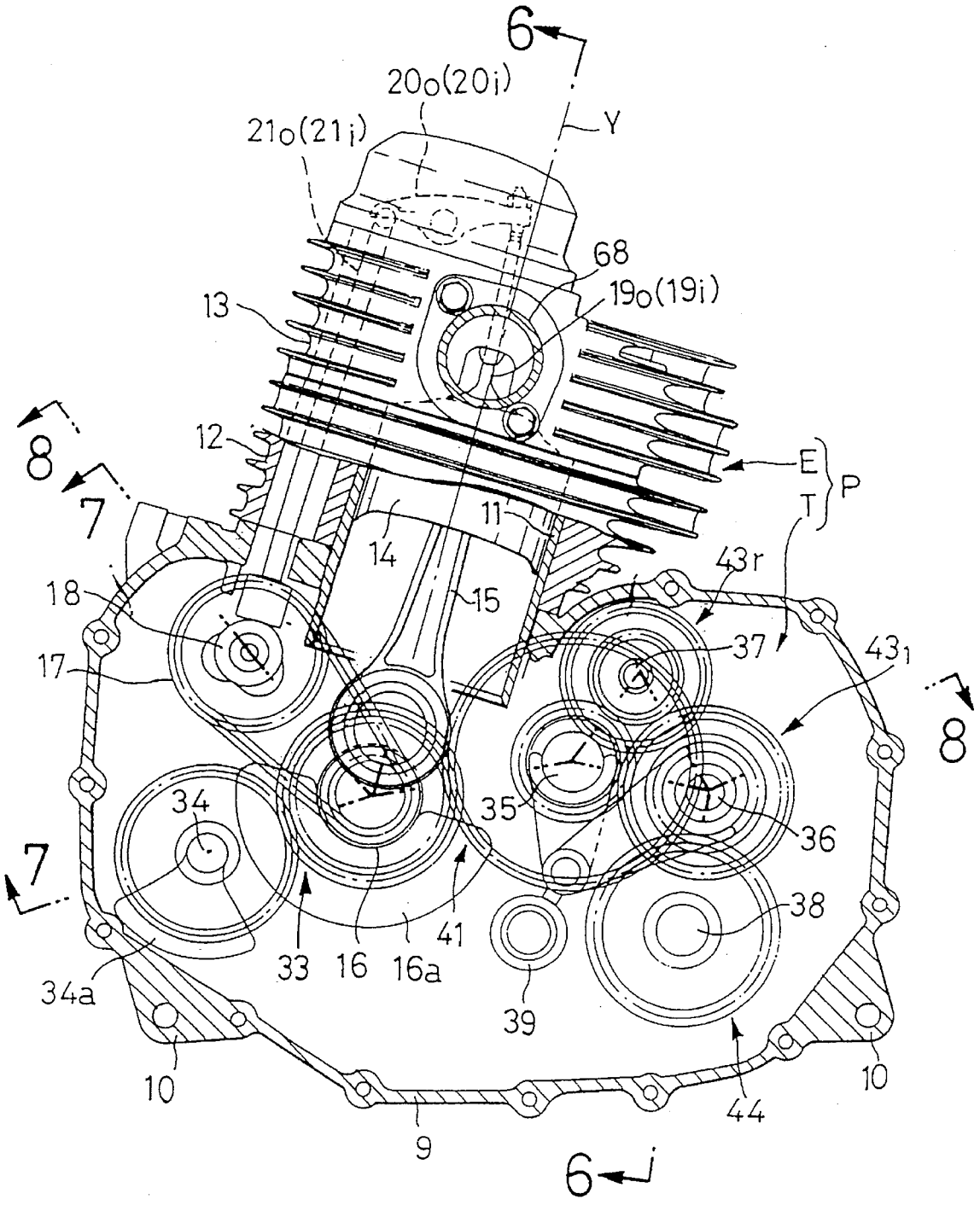
FIG. 5 is an enlarged cross-sectional view taken along a line 5—5 of FIG. 3.
Figure 6:
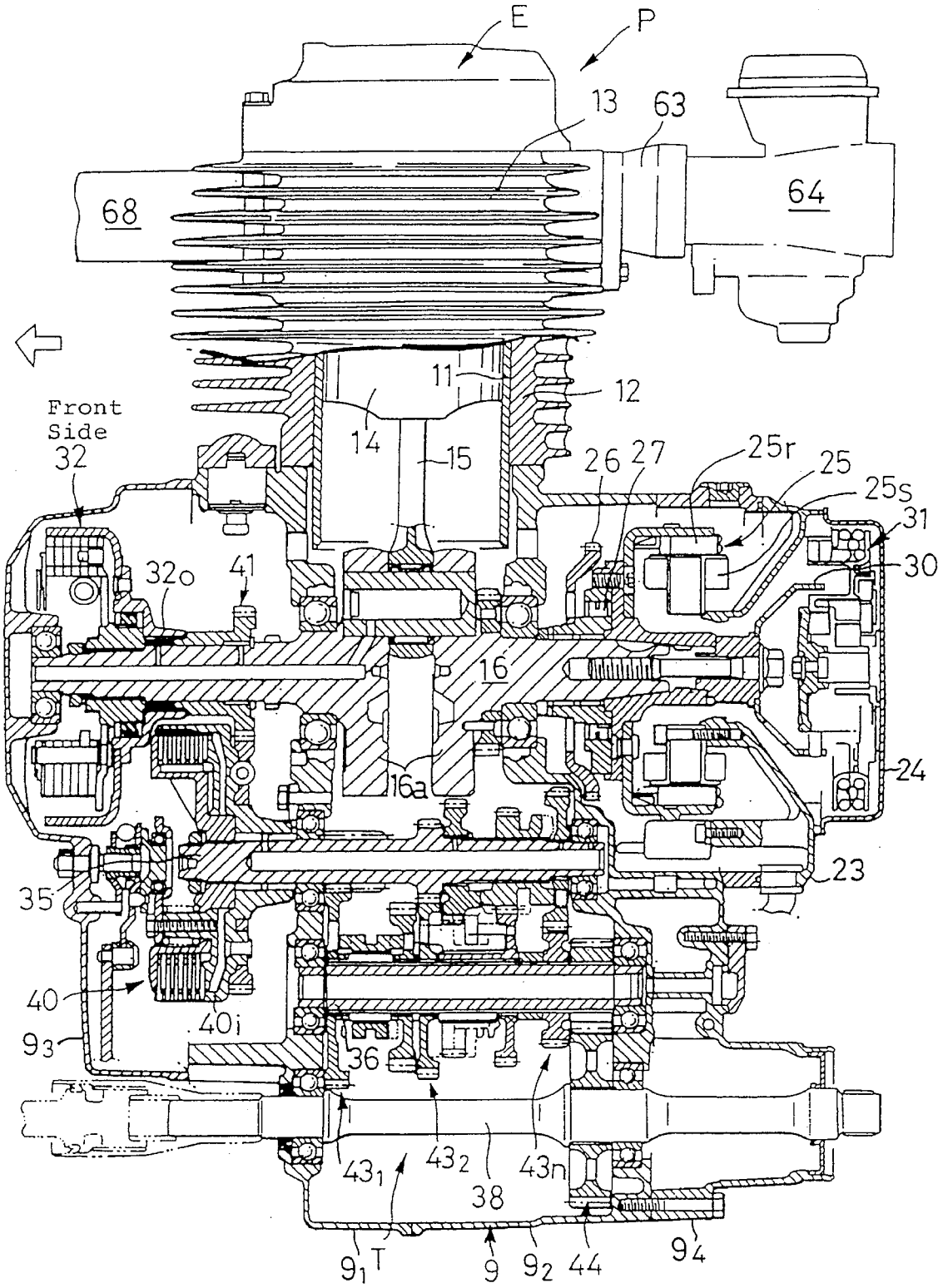
FIG. 6 is a cross-sectional view taken along a line 6—6 of FIG. 5.

As shown in FIGS. 5 and 6, the power unit P includes the engine E and a power transmission T integrated together. In other words, a crank case of the engine E and a transmission case of the power transmission T are integrally formed as the casing 9. On its two sides, the lower section of the casing 9 has fitting bosses 10, 10 which are connected to the body frame B by means of the elastic mounting members 56, 56.

Figure 7:
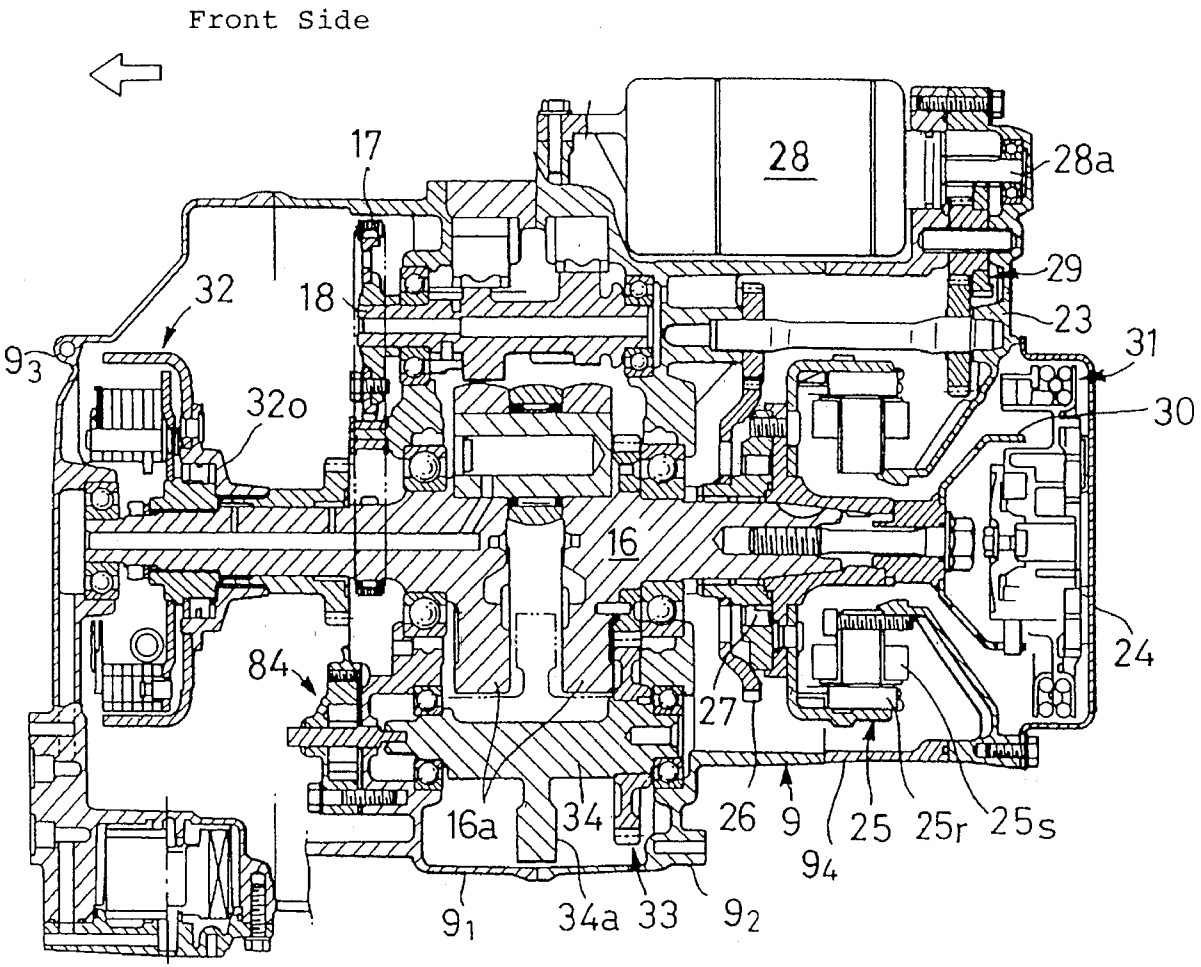
FIG. 7 is a cross-sectional view taken along a line 7—7 of FIG. 5.

As illustrated in FIGS. 3, 6 and 7, the casing 9 is composed of four sections fitted together on their joining surfaces extending in the transverse direction of the vehicle body, namely, a casing front section $\mathbf{9}_1$ and a casing rear section $\mathbf{9}_2$, a front cover $\mathbf{9}_3$ connected to a front opening of the casing front section $\mathbf{9}_1$ and a rear cover $\mathbf{9}_4$ connected to a rear opening of the casing rear section $\mathbf{9}_2$.

The engine E is composed of a cylinder block 12 having a cylinder 11, a cylinder head 13 fitted to the upper end of the cylinder block, a piston 14 slidably mounted inside the cylinder 11, a crank shaft 16 connected with the piston 14 by a connecting rod 15 and a cam shaft 18 driven by the crank shaft 16 through a chain 17 at a reduced speed. The crank shaft 16 and the cam shaft 18 are supported by the casing 9 integrally formed with the lower end of the cylinder block 12. The cylinder head 13 is provided with air inlet and outlet valves **19*i*, 19*o* and rocker arms 20*i*, 20*o* actuating the valves for opening and closing. The locker arms 20*i*, 20*o* are driven by the cam shaft 18 through push rods 21*i*, 21*o***.

The crank shaft 16 is positioned with both of its ends directed in the longitudinal direction of the vehicle body. The cylinder block 12 is provided to direct the cylinder axis Y to be inclined toward the power transmission T which is located on one side of the crank shaft 16. On the other side of the cylinder axis Y in its inclined position, the cam shaft 18 is set at a position higher than the crank shaft 16.

Figure 8:
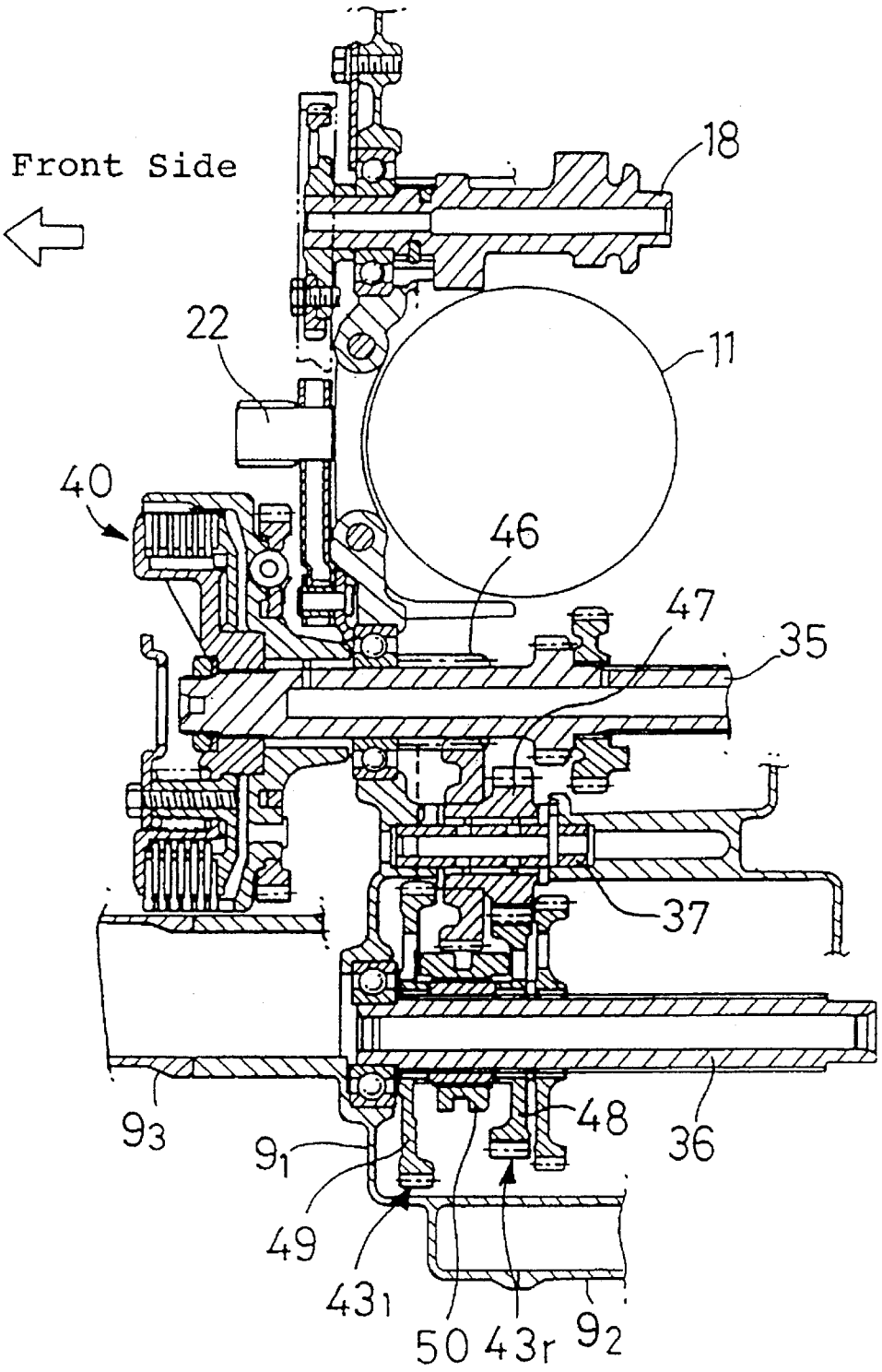
FIG. 8 is a cross-sectional view taken along a line 8—8 of FIG. 5.

As illustrated in FIG. 8, the chain 17 linking between the crank shaft 16 and the cam shaft 18 is given an adequate degree of tension by a tensioner 22.

An intake port opening an inlet is provided on the rear surface of the cylinder head 13. To this opening, the above-described carburetor 64 is fitted via the inlet pipe 63. An exhaust port opening an outlet is provided on the front surface of the cylinder head 13. The above-described exhaust pipe 68 is fitted to this opening.

Figure 9:
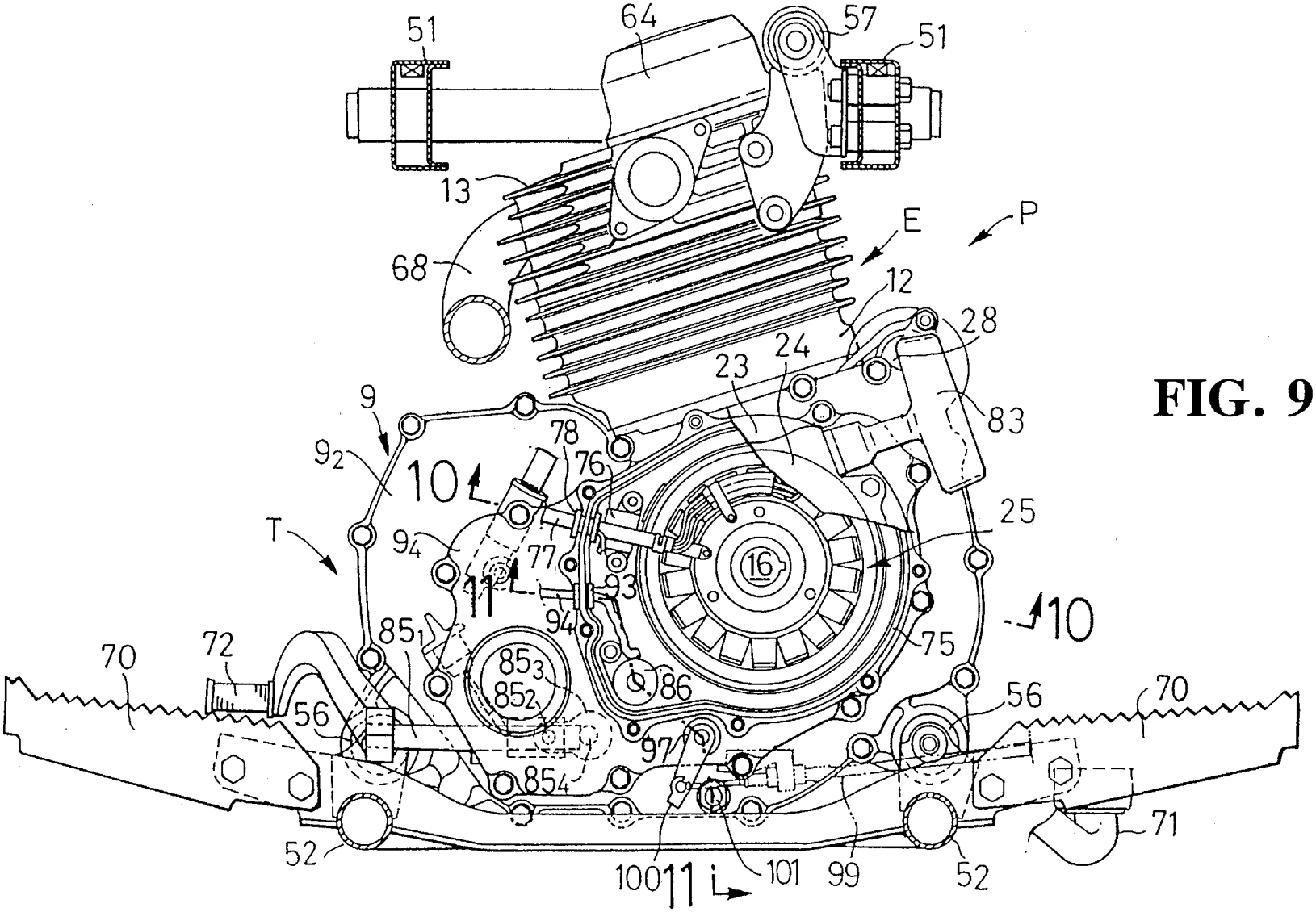
FIG. 9 is an enlarged view as seen in a direction shown by an arrow in FIG. 4.
Figure 10:
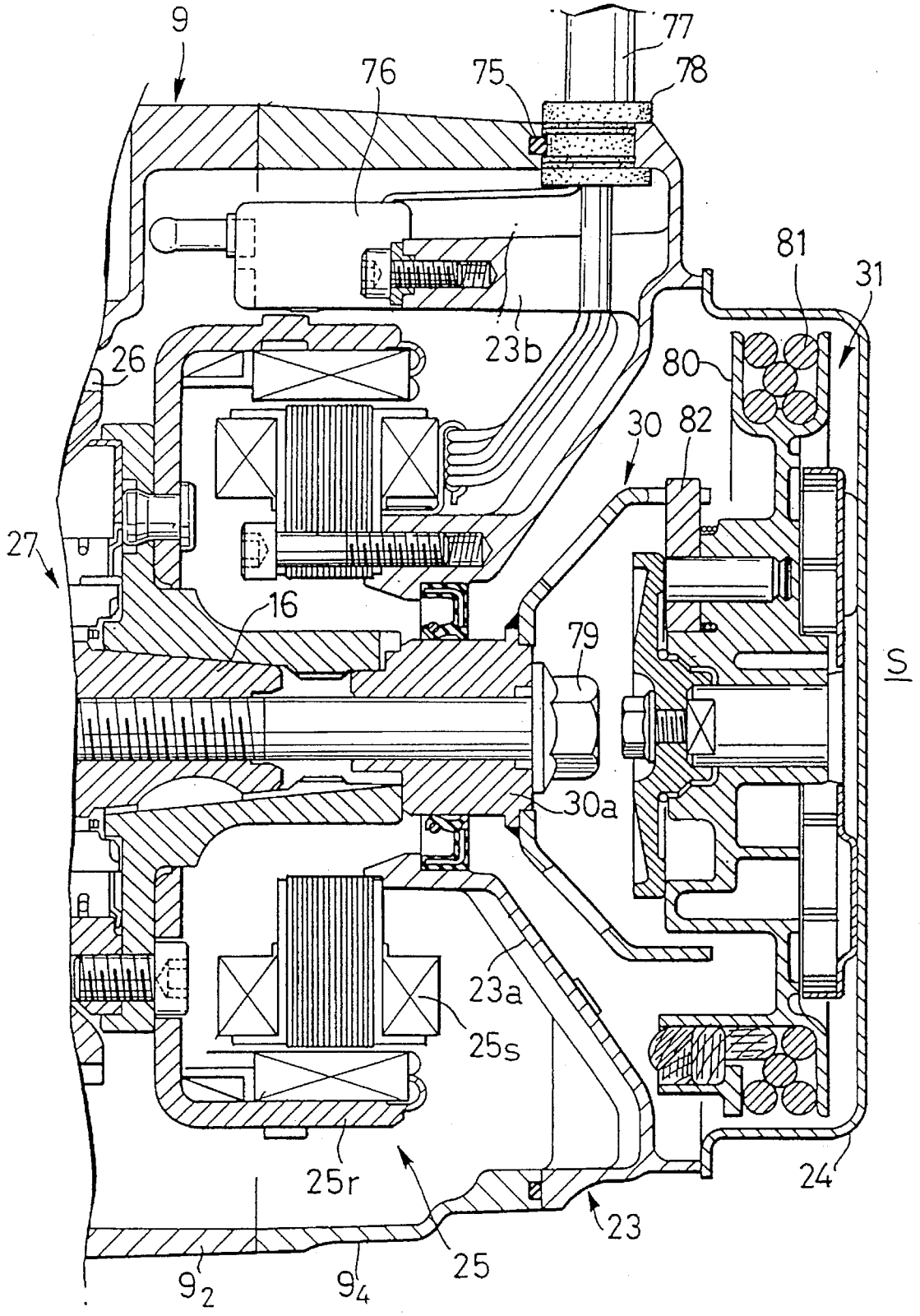
FIG. 10 is an enlarged cross-sectional view taken along a line 10—10 of FIG. 9.

As is apparent from FIGS. 9 and 10, a generator 25 is provided with its rotor **25*r* fitted in a rear end section of the crank shaft 16 and its stator 25*s* secured to a conical support 23*a* formed integrally with a generator cover 23 connected to a rear end opening of the rear cover 94 of the casing 9 through an O-ring 75. The generator cover 23 includes a boss 23*b* projecting forward therefrom to which a rotation sensor 76 is fitted to detect the rotational frequency of the rotor 25*r*, that is, the rotational frequency of the crank shaft 16**.

The harness 77 connecting to the stator **25*s* and the rotation sensor 76 project outside the casing 9 through a grommet 78 held between the joining surfaces of the rear cover 94 and the generator cover 23. The harness 77 is connected to the stator 25*s* and the rotation sensor 76 such as the electric devices are installed inside the casing 9. The electrical connections are taken outside the casing 9 through the grommet 78 held between the joining surfaces of the rear cover 94 and the generator cover 23 which are detachably fitted thereto. Thus, maintenance can readily be performed for devices such as the generator 25 and the rotation sensor 76 by only taking off the generator cover 23**.

If the above-described constitution is not employed, the rear cover $\mathbf{9}_4$ needs to be detached from the casing rear section $\mathbf{9}_2$ to allow such maintenance, making it inevitable to detach the rear driving axles 59 from the output shaft 38 making the required work complicated and troublesome and time-consuming as described later. In the above-described embodiment of the present invention, however, maintenance for devices such as the generator 25 and the rotation sensor 76 only needs detaching of the generator cover 23 without affecting the other constituent elements, making all the required work extremely easy and convenient.

As shown in FIG. 3, a space S is provided at a rear section of the generator cover 23 for inserting a tool such as an impact wrench. This only requires the generator cover 23 to be removed with the power unit P mounted on the vehicle body. This operation can greatly improve workability in maintenance for the generator 25 and other devices.

Behind the rotor **25*r*, a starting gear 26 with a greater diameter is provided which is supported to the crank shaft 16. This starting gear 26 is linked to the rotor 25*r* through a one way clutch 27. As illustrated in FIG. 7, the starting gear 26 is linked to an output shaft 28*a* of a starter motor 28 through a reduction gear device 29. When the starting gear 26 is driven under the action of the starter motor 28, it can crank the crank shaft 16 through the one way clutch 27 and the rotor 25*r*. When the engine E is started, the one way clutch 27 is released, shutting off the transmission of rotation from the rotor 25*r* to the starting gear 26**.

To the extreme end of the crank shaft 16, a boss **30*a* of a starting wheel 30 is fitted and secured to the crank shaft 16 by a bolt 79 together with the rotor 25*r*. The generator cover 23 includes a recoil starter cover 24 with a recoil starter 31 provided therein connected to its rear opening. The recoil starter 31 is composed of a starter drum 80, a rope 81 wound around the starter drum and a claw 82 provided to the starter drum 80 to engage with the starting wheel 30. As illustrated in FIG. 9, the crank shaft 16 can also be cranked by hauling a knob 83 provided on the tip of the rope 81**.

FIGS. 5 and 8 illustrate the crank shaft 16 which includes a centrifugal starting clutch 32 provided at its fore end. The casing 9 supports a balancer shaft 34 which is driven in a reverse direction by a synchronous gear device 33 under the cam shaft 18. The balancer shaft 34 includes at its intermediate section a weight 34*a* which can intervene between a pair of webs 16*a* of the crank shaft 16 with its centrifugal force eliminating or lessening primary vibration of the engine E. The balancer shaft 34 has one of its ends connected to a lubricating oil pump 84 in a manner to allow the latter to be driven from the balancer shaft 34.

The power transmission T has a main shaft 35, a counter shaft 36, a reverse shaft 37 and an output shaft 38 which are supported to the casing 9 in parallel with the crank shaft 16. By this constitution, the four shafts 35 to 38 are positioned on the other side of the crank shaft 16 opposite to the cam shaft 22 and the balancer shaft 34 with the main shaft 35 and the counter shaft 36 among them being set in roughly the same position of crank shaft 16. The reverse shaft 37 is located above the primary and counter shafts 35, 36 and the output shaft 38 is provided under the counter shaft under the primary and counter shafts 35, 36 with its position set closer to the counter shaft 36. A shift drum 39 operated by the change pedal 72 is provided under the main shaft 35 with its position relative to the crank shaft 16 being set closer than that of the output shaft 38.

The main shaft 35 has a multiple disc gear clutch 40 provided at one of its ends. The gear clutch 40 has an input member 40*i* linked with an output member 32*o* of the starting clutch 32 through a primary reduction gear device 41. The gear clutch 40 is operated under the initial rocking motion of the change pedal 72.

A train of multistage transmission gears $43_1$ to $43_n$ are provided between the main shaft 35 and the counter shaft 36, linking the main shaft 35 and the counter shaft 36 when selected under the action of the shift drum 39. The counter shaft 36 and the output shaft 38 are linked together through a secondary reduction gear device 44. The two longitudinal ends of the output shaft 38 project to link with the front and rear driving axles 58, 59.

As shown in FIG. 8, a train of reverse gears 43*r* over the main shaft 35, the reverse shaft 37 and the counter shaft 36 are provided. The train of reverse gears 43*r* is rotatably supported on a driving wheel 46 provided on the main shaft 35. A stepped idle gear 47 is rotatably supported on the reverse shaft 37 and the counter shaft 36 and includes a driven gear 48 to engage with the driving gear 46 through the idle gear 47. The counter shaft 36 has a dog clutch 50 slidably spline-fitted between a driven gear 49 of the train of the primary transmission gear $43_1$ and the driven gear 48 of the train of reverse gear $43_r$ so that the primary transmission gear $43_1$ establish their train when the dog clutch 50 is engaged with the driven gear 49 and the reverse gears $43_r$ establish their train when the dog clutch is engaged with the driven gear 48.

Figure 11:
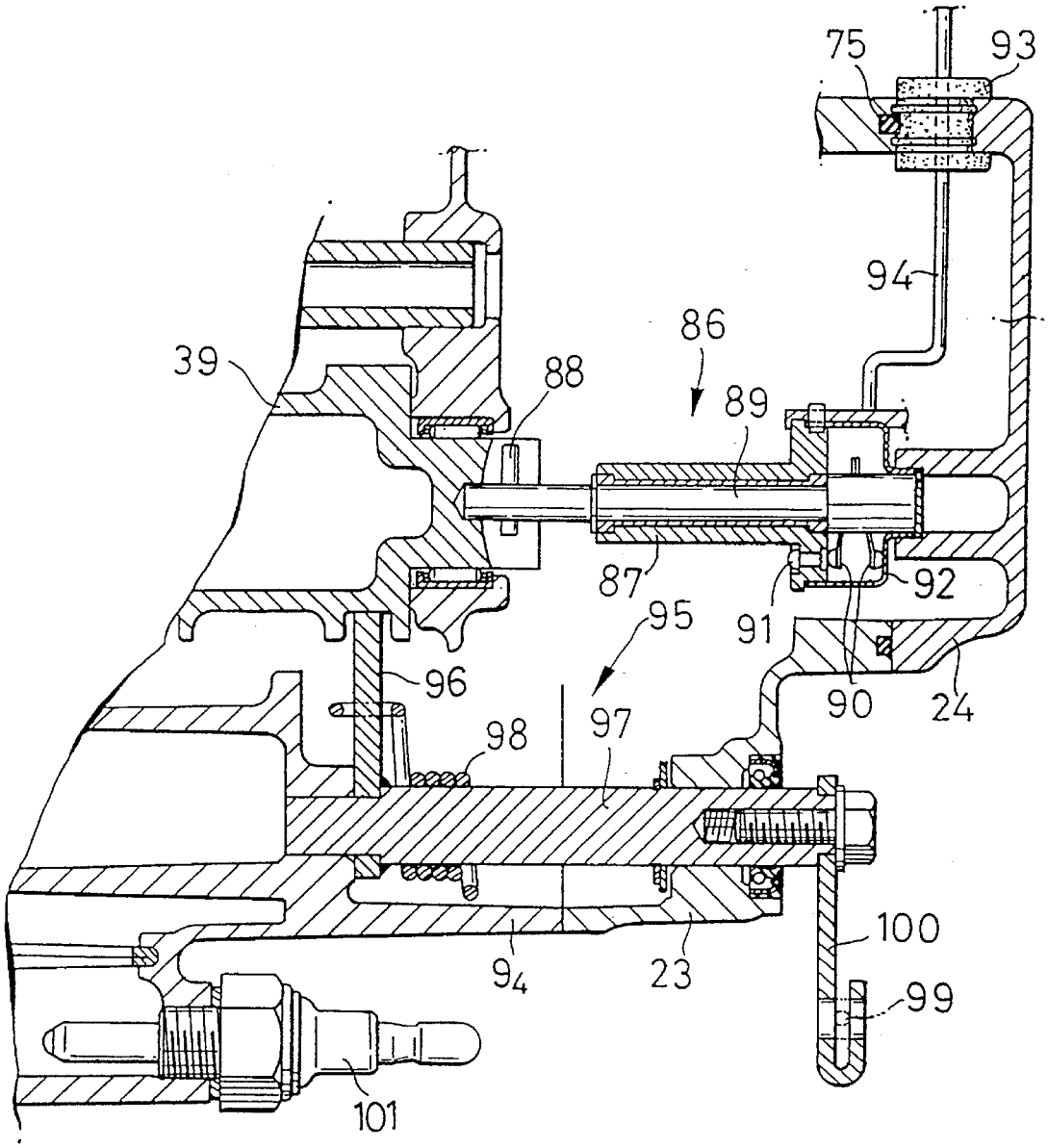
FIG. 11 is an enlarged cross-sectional view taken along, a line 11—11 of FIG. 9.

As shown in FIGS. 9 and 11, the rotation of a primary shift spindle $85_1$ linked to the change pedal 72 is transmitted to a secondary shift spindle $85_4$ through a pin $85_2$ and an arm $85_3$. At the rear end of the shift drum 39 connected to the secondary shift spindle 854 through a shift drum driving mechanism (not shown), there is provided a neutral switch 86 which detects the neutral position of the shift drum 39. The neutral switch 86 is composed of a switch housing 87 supported to the generator cover 23 connected to the rear cover 94 of the casing 9. A rotary shaft 89 is rotatably supported on the switch housing 87 and is connected to the rear end of the shift drum 39 by means of a pin 88. A movable contact 90 is provided on the rotary shaft 89 and a pair of fixed contacts 91, 92 are provided with which the movable contact 90 can be brought into contact.

Between the joining faces of the rear cover $9_4$ and the generator cover 23, a grommet 93 is inserted. A harness 94 extends from the neutral switch 86 which is led outside the casing through the grommet 93. When the generator cover 23 is removed to maintain the generator 25, the neutral switch 86 can be removed at the same time for its maintenance.

As shown in FIG. 3, a space S is provided at the rear section of the power unit P as described above. The generator cover 23 can be removed through this space S while leaving the power unit P mounted on the vehicle body. Thus, it is possible and easy to remove and maintain the electric devices such as the generator 25, the rotation sensor 76 and the neutral switch 86 fitted to the generator cover 23. As the generator cover 23 is relatively small as compared with the rear cover $9_4$ and does not require the rear driving axle 59 linking to the rear wheels Wr, Wr to be removed together with the generator cover 23, maintenance work is extremely easy and can be completed in a short time.

Between the joining surfaces of the rear cover 94 and the generator cover 23, there is provided a reverse lock mechanism 95. This reverse lock mechanism 95 is composed of a reverse lock arm 96 engaging with the outer periphery of the shift drum 39 to prevent the establishment of a reverse shift. A reverse lock spindle 97 is rotatably supported to the rear cover 94 and the generator cover 23 to support the reverse lock arm 96. A spring 98 energizes the reverse lock spindle 97 in a direction to engage the reverse lock arm 96 with the outer periphery of the shift drum 39. A reverse lock release arm 100 is provided at an outer end of the reverse lock spindle 97 and is connected through a Bowden cable 99 to a reverse lock release lever 102, as shown in FIGS. 1 and 2, provided on the handle bar 1.

If desired, a reverse shift can be established by operating the reverse lock release lever provided on the handle bar 1 to release engagement between the reverse lock arm 96 and the shift drum 39 and operating the change pedal 72 to rotate the shift drum 39 into its reverse position. This prevents a backward shift from being accidentally or mistakenly established while the sitting-type vehicle V is moving forward.

To measure the temperature of oil in an oil pan provided at the bottom of the casing 9, a temperature sensor 101 is provided under the reverse lock mechanism 95. As this temperature sensor 101 and the outer end of the reverse lock spindle 97 project backward from the rear surface of the power unit P, there is no need to provide a special cover or the like to prevent their interference with the driver's legs. This contributes to a reduction of components and secures adequate leg space.

While a preferred embodiment of the present invention now has been described, variations and modification thereto will occur to those skilled in the art within its spirit and scope.

For example, electric devices to be installed are not limited to the generator 25, the rotation sensor 76 or the neutral switch 86 as employed in the above-described embodiment and may be any other electric devices. The generator cover 25 can be replace by any equivalents of the same and such a cover can be fitted to a front surface of the casing 9 instead of the rear surface as described above.

As described above, a power unit according to the present invention wherein the casing for an engine has a cover detachably provided thereto at a position off the output shaft on the front or rear surface of the casing, the cover has fitted to its inner surface electric devices and harnesses extending from the electric devices which are taken to the outside between joining surfaces of the casing and the cover. Therefore, such electric devices can be easily removed and maintained only by detaching the cover from the casing. The cover, located off the position of the output shaft, is easy and convenient to remove and realizes highly improved workability in maintenance.

A power unit for a sitting-type vehicle includes a space at the front or rear section of the cover to detach the cover from the casing. It is possible to remove the cover for maintenance of electric devices fitted to it while leaving the engine mounted on the vehicle body. Workability with maintenance is greatly improved as a result.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A casing for an engine having a crank shaft, said engine and crank shaft being mounted in a longitudinal direction of the vehicle body comprising:

an output shaft operatively connected to driving wheels and projecting from said casing in the longitudinal direction of the vehicle body;

a cover detachably connected to said casing at a position displaced from the output shaft on the front surface of the casing, said cover enclosing electric devices and harnesses extending from the electric devices being taken outside of the casing through a joining surface between the casing and the cover.

2. The casing for an engine according to claim 1, and further including a space at the front section of the cover to detach said cover from the casing while leaving the engine mounted on the vehicle body.

3. The casing for an engine according to claim 1, and further including a grommet disposed between said casing and the cover for permitting said harnesses to extend therethrough.

4. The casing for an engine according to claim 1, and further including a reverse lock mechanism operatively connected to said engine, a reverse lock arm connected to said reverse lock mechanism and projecting from said cover to enable manual operation thereof.

5. A casing for an engine having a crank shaft, said engine and crank shaft being mounted in a longitudinal direction of the vehicle body comprising:

an output shaft operatively connected to driving wheels and projecting from said casing in the longitudinal direction of the vehicle body;

a cover detachably connected to said casing at a position displaced from the output shaft on the rear surface of the casing, said cover enclosing electric devices and harnesses extending from the electric devices being taken outside of the casing through a joining surface between the casing and the cover.

6. The casing for an engine according to claim 5, and further including a space at the rear section of the cover to detach said cover from the casing while leaving the engine mounted on the vehicle body.

7. The casing for an engine according to claim 5, and further including a grommet disposed between said casing and the cover for permitting said harnesses to extend therethrough.

8. The casing for an engine according to claim 5, and further including a reverse lock mechanism operatively connected to said engine, a reverse lock arm connected to said reverse lock mechanism and projecting from said cover to enable manual operation thereof.

* * * * *